US007076189B2

(12) United States Patent
Yoshino

(10) Patent No.: US 7,076,189 B2
(45) Date of Patent: Jul. 11, 2006

(54) IMAGE FORMING APPARATUS WITH SIMPLIFIED REMOVAL OF COMPONENTS

(75) Inventor: Naoto Yoshino, Ebina (JP)

(73) Assignee: Fuji Xerox Co, Ltd, Tokyo (JP)

( * ) Notice: Subject to any disclaimer, the term of this patent is extended or adjusted under 35 U.S.C. 154(b) by 103 days.

(21) Appl. No.: 10/830,226

(22) Filed: Apr. 23, 2004

(65) Prior Publication Data

US 2004/0228653 A1 Nov. 18, 2004

(30) Foreign Application Priority Data

May 14, 2003 (JP) ..... 2003-135412

(51) Int. Cl.
*G03G 15/08* (2006.01)

(52) U.S. Cl. ..... 399/121; 399/302; 399/308

(58) Field of Classification Search ..... 399/107, 399/110, 121, 297, 298, 302, 303, 308
See application file for complete search history.

(56) References Cited

U.S. PATENT DOCUMENTS 5,983,062 A * 11/1999 Sameshima ..... 399/302
6,349,192 B1 * 2/2002 Yoshino et al. ..... 399/302
6,856,782 B1 * 2/2005 Takahata et al. ..... 399/302
6,865,361 B1 * 3/2005 Abe et al. ..... 399/302

FOREIGN PATENT DOCUMENTS

JP 2000-275987 10/2000

* cited by examiner

*Primary Examiner*—Hoan Tran
(74) *Attorney, Agent, or Firm*—Morgan, Lewis & Bockius, LLP

(57) ABSTRACT

An image forming apparatus has a case, an image carrier, an endless belt and a contact member, provided in the case. The image carrier supports an image. The endless belt contacts the image carrier and it is detachably attached to the image carrier. The contact member contacts the endless belt and moves with the endless belt when the endless belt is detached from the image carrier. Moreover, the contact member is pulled out from the case by separating from the endless belt, where the endless belt contacts the image carrier and the endless belt removes it from the image carrier.

14 Claims, 11 Drawing Sheets

IMAGE FORMING APPARATUS WITH SIMPLIFIED REMOVAL OF COMPONENTS

BACKGROUND OF THE INVENTION

1. Field of the Invention

The presently disclosed embodiments of the claimed invention relate to an image forming apparatus of a printer, a copy machine, or the like, and in particular, they relate to an image forming apparatus having plural image forming units.

2. Discussion of the Related Art

It is often desirable to form a high quality color image at a high speed by an image forming apparatus of a printer, a copy machine, a facsimile, or the like. Full-color tandem copy machines are known. Such tandem machines arrange four image forming units, yellow(Y), magenta(M), cyan(C), black(K), for example, in series, forming each toner image sequentially. Each of the toner images formed by the image forming units are overprinted (first transfer) to an intermediate transfer belt, which serves as an intermediate transfer body, before being transferred again (second transfer), all at one time, from the intermediate transfer belt to transfer paper. Subsequently, by fixing the toner image formed on the transfer paper, full-color as well as monochrome images may be produced.

In a conventional image forming apparatus that uses an intermediate transfer body, a photosensitive drum, which functions as an image carrier, is provided in each image forming unit. The photosensitive drum contacts the intermediate transfer belt laid across it, which is maintained in a tensioned condition by plural rollers. In conventional designs, when maintenance is necessary, for example replacing the photosensitive drum or other components, the photosensitive drums, which are in contact with the intermediate transfer belt, are pulled out individually.

In conventional systems, a guide rail is provided that allows the transfer belt to disengage from the photosensitive drum. This is described in pages 4 and 5 and FIG. 4 of Japanese Patent Laid-Open Publication No. 275987/2000. The guide rail system makes it possible to locate the transfer belt in precise relation to the photosensitive drum, while allowing the belt to be disengaged and the photosensitive drum to be pulled out for removal.

SUMMARY OF THE INVENTION

The present invention has been made in view of the above circumstances and, in an embodiment, provides an image forming apparatus which simplifies removal of various components (e.g., the photosensitive drum, intermediate transfer body (belt), second transfer members, etc.) for maintenance, jam clearance, or the like, while maintaining the position between the components with high accuracy for high image quality and reliability. According to the Japanese Patent Laid-open No. 275987/2000, mentioned above, by pulling out the intermediate transfer body, it is possible to remove the photosensitive drum from the intermediate transfer body. However, when a photosensitive drum unit is removed in this manner, the intermediate transfer body must first be disengaged from the photosensitive drum by sliding the intermediate transfer body away from the photosensitive drum, making removal complicated during servicing. Additionally, when pulling out the intermediate transfer body in this way, it is easy to damage the photosensitive drum and the intermediate transfer body, since the photosensitive drum and intermediate transfer body may rub together causing scratches or other damage. Moreover, the method of the Japanese Patent Laid-Open Publication No. 275987/2000 cannot be applied in certain systems where the second transfer member and the photosensitive drum are respectively located above and below the intermediate transfer body.

To solve the above technological issues, in an embodiment, an object of the present invention is to control damage when various components are removed, for example, the contact member (photosensitive drum) which contacts the endless belt, the paper transport belt, and the intermediate transfer belt. In another embodiment, an object is to avoid damage even in certain systems where the second transfer member and the photosensitive drum are respectively located above and below the intermediate transfer body. In another embodiment, the invention has an object to simplify maintenance operations (e.g., the number of steps that must be performed to remove components), and to conserve work space by providing a more compact design.

To attain these objects, the image forming apparatus in an embodiment of the present invention provides a case containing an image carrier (drum) provided for supporting the image, and an endless belt provided for contacting the image carrier, the endless belt being detachably attached to the image carrier. In addition, the image forming apparatus has a contact member (roller) provided in the case for contacting the endless belt, the contact member moving with the endless belt when the endless belt is detached from the image carrier. In an embodiment, it is possible to pull out the contact member from the case separately from the endless belt, regardless of whether the endless belt is in contact with the image carrier or if the endless belt is removed it from the image carrier.

In an embodiment, the contact member (roller) is intended to disengage from the endless belt according to a set timing, for example at predetermined maintenance intervals, of the image forming apparatus by applying an electrical retract mechanism, for example, and to detach from the endless belt when the contact member is pulled out from the case. In an embodiment, the contact member is only engaged during operation when paper is fed through.

In an embodiment, the endless belt may be an intermediate transfer belt or a paper transport belt. The plural image carriers (drums) are arranged to contact the endless belt. It is possible to enhance operability by detaching the endless belt from the image carriers in a single operation (i.e., at one time). The present invention is applicable to systems that employ direct transfer of the image onto the paper, as well as to systems that employ transfer of the image onto an intermediate transfer belt before transferring the image to paper. For example, the image carriers may overprint the toner image sequentially on a recording sheet conveyed by the endless belt or on the endless belt directly.

In an embodiment, the present invention includes a main body of the image forming apparatus, and a central unit having the endless belt positioned in the main body, and a first image forming unit having a first member (drum) being in contact with a surface of the endless belt, and a second image forming unit having a second member (drum) being contacted by an opposite surface of the endless belt. In an embodiment, the central unit moves together with the second unit in a direction to detach the endless belt from the first member. The second unit operates to detach the second member from the endless belt when image formation is not performed, and it is possible to pull out the second unit independently from the main body and without moving the central unit. The second unit is attached in a manner to position it to the central unit by pushing the second unit into the main body from the state which the second unit is pulled out, regardless of whether the central unit moves or not.

Additionally, the image forming apparatus according to an embodiment of this invention has the image carrier provided in the main body for supporting the image, and the intermediate transfer body provided in the main body for transferring (first transfer) the image which is supported by the image carrier, and the second transfer member for transferring the first transferred image which is on the intermediate transfer body to the recording sheet. This second transfer member moves together with the intermediate transfer body in a direction to detach the intermediate transfer body from the image carrier, making it possible to receive the driving force from the main body before and after the second transfer member moves. Here, this second transfer member includes a transmission gear and receives the driving force by connecting the transmission gear and a main body gear. In addition, the second transfer member provides the transmission gear in a direction perpendicular to the direction which the second transfer member moves in relation to the main body gear. Therefore, since the gear is surely engaged before and after the second transfer member moves, it possible to prevent damage to the components and resulting malfunctions, or the like.

BRIEF DESCRIPTION OF THE DRAWINGS

Embodiments of the present invention will be described in detail based on the following figures, wherein.

DETAILED DESCRIPTION OF THE PREFERRED EMBODIMENTS

Figure 1:
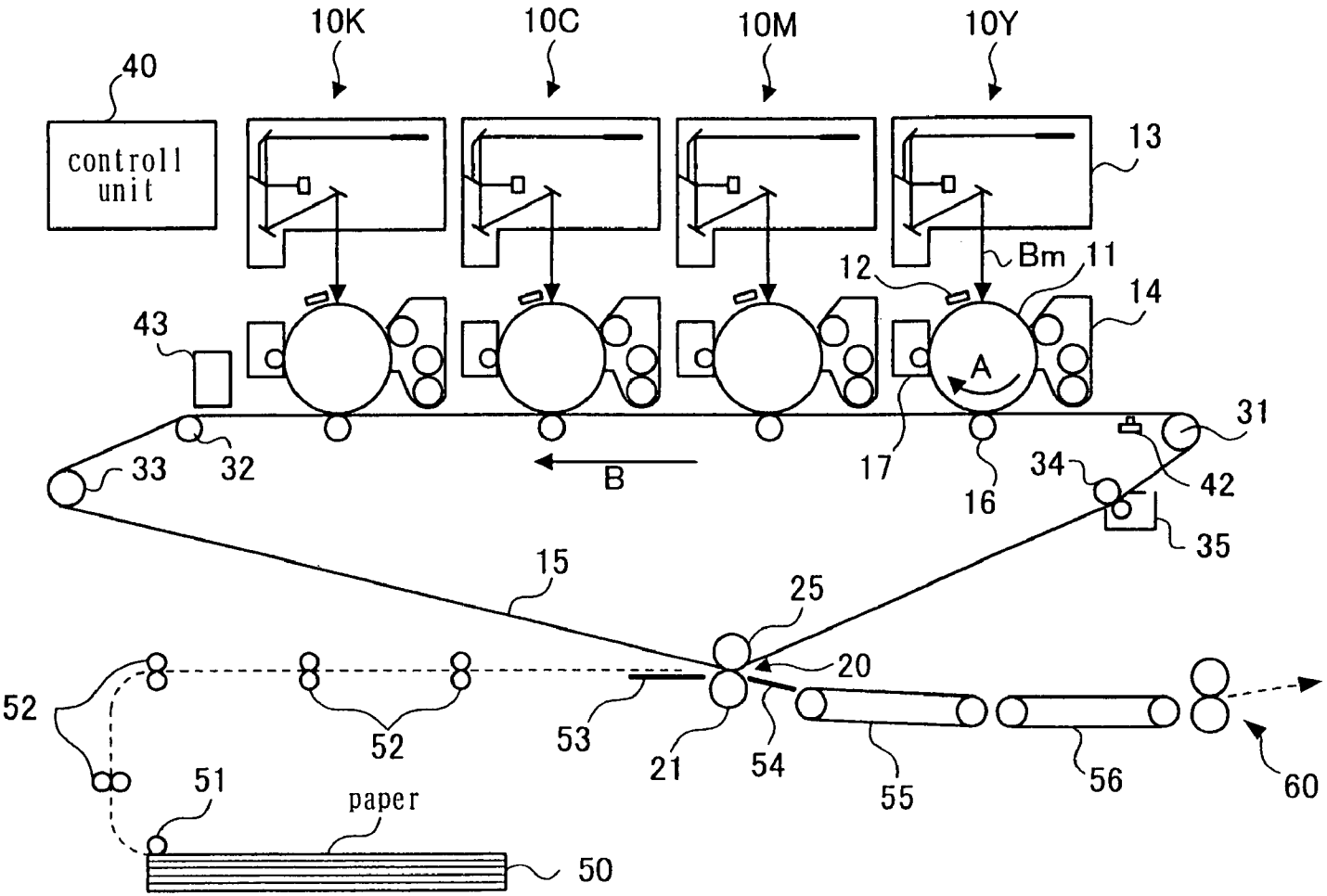
FIG. 1 is a schematic view showing an example of an image forming apparatus to which embodiments of the present invention can be applied.

FIG. 1 is a schematic view showing an example of an image forming apparatus to which the present invention can be applied. The image forming apparatus as shown in FIG. 1, is a general type of an image forming apparatus which uses an intermediate transfer system in tandem. The image forming apparatus according to an embodiment of the present invention may be applied to electro-photography. The image forming apparatus includes plural image forming units 10 (10Y, 10M, 10C, 10K) for forming toner images of each color, an intermediate transfer belt 15 which is one of the endless belts for transferring (first transfer) the toner images sequentially and maintaining the images made by the image forming units, a second transfer member 20 for transferring (second transfer) the overprinted toner images from an intermediate transfer belt 15 to a recording sheet recording medium (a transfer medium) at one time, and a fixing unit 60 for fixing the images from the second transfer to the recording sheet. The image forming apparatus further includes a control unit 40 for controlling all units of the apparatus.

In an embodiment, every image forming unit 10 (10Y, 10M, 10C, 10K) includes a photosensitive drum 11 as a first member (a first contact member) for contacting the intermediate transfer belt 15. Every image forming unit 10 (10Y, 10M, 10C, 10K) arranges components for electro-photography around the photosensitive drum, which rotates in a direction shown by the arrow A. For example, the components include an electrified unit 12 for electrifying the photosensitive drums 11, a laser photolithography machine 13 for exposing an electrostatic latent image to the photosensitive drums 11 ("Bm" indicates an exposure beam in the figures), and a developing unit 14 containing colored toner for developing the electrostatic latent image which is on the photosensitive drums 11. In an embodiment, the unit 10 further includes a first transfer roller 16 for transferring the colored toner image formed on the photosensitive drum 11 to the intermediate transfer belt 15, and a drum cleaner 17 for removing the remaining toner from the photosensitive drum 11. In an embodiment, the image forming units 10 are arranged in series from upstream of the intermediate transfer belt 15 in order of yellow(Y), magenta(M), cyan(C), and black(K). In an embodiment, every first transfer roller 16 is formed inside of the intermediate transfer belt 15 which extends in line and faces every photosensitive drum 11. During operation, the first transfer roller 16 is impressed with a voltage which is opposite polarity to the charged toner. Therefore, the toner image on every photosensitive drum 11 is attracted to the intermediate transfer belt 15 sequentially by an electrostatic force and then the toner image overprinted on the intermediate transfer belt 15 is formed.

In an embodiment, the intermediate transfer belt 15 (an intermediate transfer body) may be a flexible polyimide or other resin like material containing an adequate amount of a conducting material such as carbon black. In addition, in an embodiment, the intermediate transfer belt 15 is composed of a film-type endless belt which has the volume resistivity about $10^6$ Ω·cm to $10^{14}$ Ω·cm and a thickness about 0.1 mm. The intermediate transfer belt 15 rotates to a direction indicated by an arrow B at a predetermined speed by the rollers. The image forming apparatus includes rollers, for example, a driving roller 31 for rotating the intermediate transfer belt 15. In an embodiment, the driving roller 31 is driven by a motor (not shown) having a superior constant-speed drive, and a supporting roller 32 for supporting the intermediate transfer belt 15 is extended in a direction along the direction that the photosensitive drums 11 are arranged. The apparatus may further include a tension roller 33 for providing constant tension to the intermediate transfer belt 15 and preventing the belt 15 from meandering, a correcting roller, and a backup roller 25 provided in a second transfer part, and a cleaning backup roller 34 provided in a cleaning part for removing the remaining toner on the intermediate transfer belt 15.

In an embodiment, the second transfer part 20 is provided on the side where the intermediate transfer belt 15 supports the toner image. Component 20 is composed of a second transfer roller 21, also referred to herein as a second member (or a second contact member), to contact the intermediate transfer belt 15, and the backup roller 25, which is provided inside the intermediate transfer belt 15. In an embodiment, the roller 25 faces the second transfer roller 21, or the like. The second transfer roller 21 and the backup roller 25 are composed of a rubber tube blended NBR and EPDM which are spread with carbon on the surface, and the inside is composed of EPDM. The second transfer roller 21 is impressed with a stable transfer bias voltage, the transfer bias being of opposite polarity (positive polarity) to the charged toner (negative polarity). The backup roller 25 may be positioned opposite to the second transfer roller 21.

In an embodiment, a paper feeder and transport mechanism are provided. The sheet tray 50 is for containing paper and pickup roller 51 is for taking out and transporting the paper from the sheet tray 50 according to a predetermined timing. The apparatus further has a transfer roller 52 for transferring paper sent by the pickup roller 51 and a transfer chute 53 for sending the paper transferred by the transfer roller 52 to the second transfer part 20. Downstream of the second transfer part 20, the apparatus has a paper releasing guide 54 for conducting the paper from the second transfer part 20, and a first transfer belt 55 and a second transfer belt 56 for conveying the paper to the fixing unit 60, where the paper is transferred with the overprinted toner image from the second transfer part 20. The first transfer belt 55 and the second transfer belt 56 are composed of the endless belt, such as EPDM, laid across in a tensioned condition by a driving roller and an idle roller.

In an embodiment, an intermediate transfer belt cleaner 35 is provided detachably downstream of the second transfer part 20 of the intermediate transfer belt 15 for cleaning a surface of the intermediate transfer belt 15 and eliminating the remained toner and the paper dust, which accumulate on the intermediate transfer belt 15 after the second transfer operation. A reference sensor (a home position sensor) 42 is provided in the upstream of the image forming unit 10Y (yellow) for generating a reference signal for counting the image forming timing. Additionally, an image density sensor 43 is provided in the downstream of the image forming unit 10K (black) for adjusting image quality.

Next, the basic process for forming an image will be explained, according to an embodiment. Image data outputted from, for example, an image input terminal (IIT) (not shown) or a personal computer (PC) (not shown), is inputted to the image forming apparatus as shown in FIG. 1. In the image forming apparatus, after performing the predetermined image processing by an image processing system (IPS) (not shown), the operation for image forming begins in the image forming unit 10. In the image processing system (IPS), the predetermined image processing of the inputted data, such as reflectance data, is performed. This includes, for example, shading correction, lightness/color space conversion, gamma control, and so on. The image data to which the image processing is applied is then converted into a four color gradation, yellow (Y), magenta (M), cyan (C), and black (K), and outputted to the laser photolithography machine 13.

The laser photolithography machine 13 exposes every photosensitive drum 11 of the image forming unit 10Y, 10M, 10C, 10K to an exposure beam, which is reflected from a laser diode, for example, and corresponds to the data of the inputted color graduation. After charging the surface of every photosensitive drum 11 by the electrified unit 12, the surface is scanned and exposed by the laser photolithography machine 13, forming the electrostatic latent image. The electrostatic latent image is developed as each toner image Y, M, C, K in the image forming units 10Y, 10M, 10C, 10K.

The toner image, which is formed on the photosensitive drum 11 of the image forming unit 10Y, 10M, 10C, 10K, is transferred to the intermediate transfer belt 15 at the first transfer part where the photosensitive drum 11 contacts the intermediate transfer belt 15. For example, in the first transfer part, at least a portion of the intermediate transfer belt 15 is charged with a voltage having a polarity (e.g., a positive polarity) opposite the polarity of the charged toner (e.g., a negative polarity) by the first transfer roller 16. The unfixed toner is overprinted sequentially on the surface of the intermediate transfer belt 15 and then the first transfer is performed. Thus, the unfixed toner is transferred (first transfer) to the second transfer part 20 with a rotation of the intermediate transfer belt 15.

In an embodiment, in the paper feeder and transport mechanism, the paper of the predetermined size is provided from the sheet tray 50 following the rotation of the pickup roller 51 with the image forming timing. The paper, which is provided by the pickup roller 51, is conveyed by the transfer roller 52 and reaches the second transfer part 20 through the transfer chute 53. Before reaching the second transfer part 20, the paper stops once, and the position of the paper and the position of the toner image are registered by rotating a register roller (not shown) in synchronized timing with the intermediate transfer belt 15, which supports the toner image.

In the second transfer part 20, the second transfer roller 21 is pressed by the backup roller 25 on both sides of the intermediate transfer belt 15. At this time, the conveyed paper is tucked between the intermediate transfer belt 15 and the second transfer roller 21. The second transfer roller 21 is impressed with a voltage (transfer bias) which is opposite polarity to the charged toner, forming the electric field for transferring between the second transfer roller 21 and the backup roller 25. The unfixed toner which is supported by the intermediate transfer belt 15 is then electrostatically transferred onto the paper at the second transfer part 20 where it is then pressed by the second transfer roller 21 and the backup roller 25.

Thereafter, the paper with the toner image electrostatically transferred thereon is conveyed on the paper releasing guide 54 to the first transfer belt 55 where the paper is released from the intermediate transfer belt 15. The first transfer belt 55 is provided upstream of the paper conveying direction of the paper releasing guide 54. The first transfer belt 55 conveys the paper to the second transfer belt 56, attracting the paper. Moreover, the second transfer belt 56 conveys the paper to the fixing unit 60, attracting the paper. The unfixed toner image on the paper, which is conveyed to the fixing unit 60, is fixed on the paper by a fixing process in which heat and pressure are applied by the fixing unit 60. The paper with the fixed image formed thereon is fed out into the outside of the apparatus by an output roller (not shown). After the paper is transferred, the toner remaining on the intermediate transfer belt 15 is conveyed to the cleaning part following with the rotation of the intermediate transfer belt 15. The remaining toner is eliminated from the intermediate transfer belt 15 by the cleaning backup roller 34 and the intermediate transfer belt cleaner 35. As has been described herein, by this process to form the toner image, color images are formed.

Figure 2:
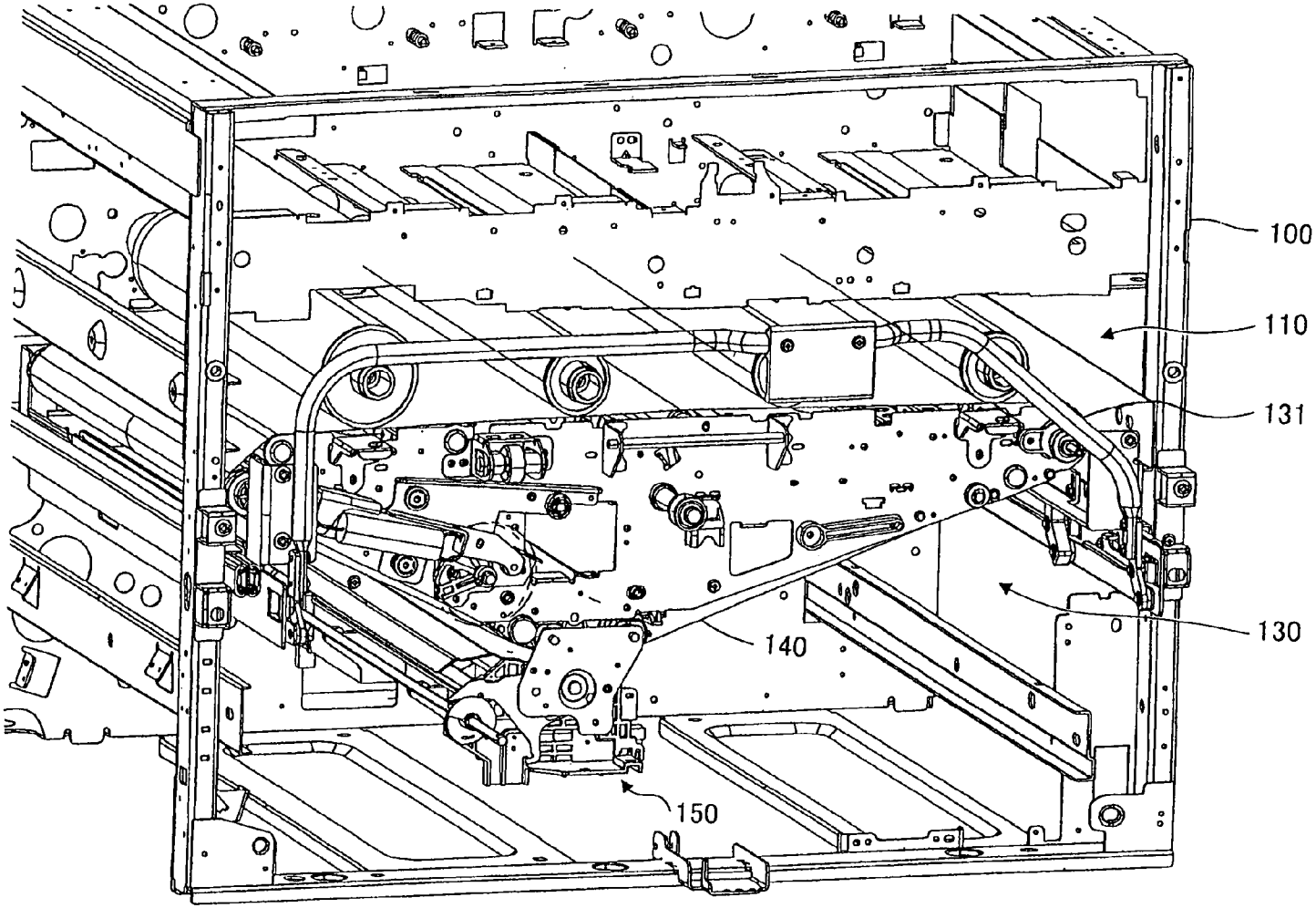
FIG. 2 represents the composite of the unit in the image forming apparatus to which embodiments of the present invention can be applied.

Next, the unit composition of the image forming apparatus will be explained according to an embodiment. FIG. 2 is a view of the unit composition of an image forming apparatus to which the present invention can be applied. As shown in the FIG. 2, the image forming apparatus according to an embodiment includes a photosensitive drum unit 110 as a first unit having the plural image forming units 10 (10Y, 10M, 10C, 10K), and a transfer unit 130 as a central unit having the intermediate transfer belt 15, and a second transfer unit 150 as a second unit having the second transfer roller 21, in a main body 100. In an embodiment, the image forming unit may be formed without laser photolithography machine 13. Additionally, the image forming unit may be formed as one unit that includes the transfer unit 130 and the second transfer unit 150. In an embodiment, these units are configured to be pulled out as a single unit from the image forming apparatus, for example, if a paper jam should occur in the second transfer part 20, and for maintenance purposes.

The transfer unit 130 includes transfer module 140, which includes the intermediate transfer belt 15 (shown in FIG. 1), and also the plural first transfer rollers 16, the driving roller 31, the supporting roller 32, the tension roller 33, the backup roller 25, and the cleaning backup roller 34. In an embodiment, the transfer unit 130 includes the transfer module 140 and a frame (described later) which supports the transfer module 140.

Figure 3:
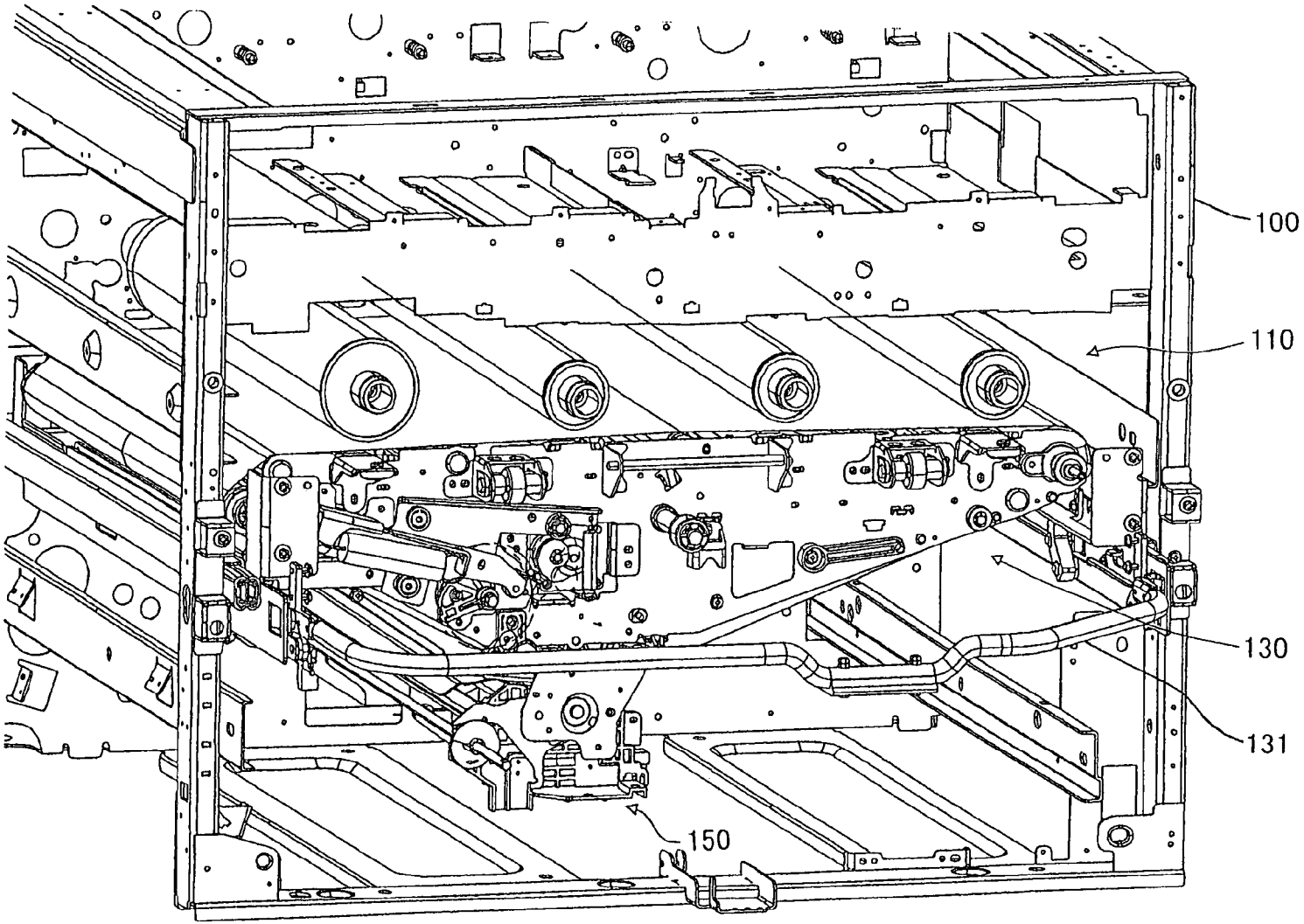
FIG. 3 is a perspective view showing the state of pulling a handle to the front in accordance with an embodiment of the present invention.

In an embodiment, a handle 131 is provided in the transfer unit 130, as shown in FIG. 2. In the configuration shown in FIG. 2, the handle 131 is lifts up and the photosensitive drum 11 contacts the intermediate transfer belt 15. By pressing the handle 131 down towards an operator in the figure, the transfer module 140 is pulled down in such a manner that the intermediate transfer belt 15 can be removed from the photosensitive drum 11. FIG. 3 shows the state in which the handle 131 has been pressed down toward the operator in the figure. By pulling out the handle 131 toward the operator, the transfer unit 130 can be pulled out from the case of the apparatus in the main body 100.

The position of the second transfer unit 150 is determined by the position of the intermediate transfer belt 15 (the transfer module 140), independently of whether the intermediate transfer belt 15 contacts the photosensitive drum 11 or not (the relative positioning of the second transfer roller 21 and intermediate transfer belt 15 is independent of whether the photosensitive drums are engaged). Before the toner image supported on the intermediate transfer belt 15 is conveyed to the second transfer part 20 and the paper is conveyed to the second transfer part 20, the second transfer roller 21 is contacted by the intermediate transfer belt 15 by a cam mechanism as will explained in more detail later. Additionally, in embodiments where the toner image is transferred directly to the paper, the second transfer roller 21 is removed from the intermediate transfer belt 15 by the cam mechanism. Therefore, when the transfer unit 130 is pulled out or pushed in, as shown in FIG. 3, the second transfer roller 21 is removed from the intermediate belt 15.

Figure 4:
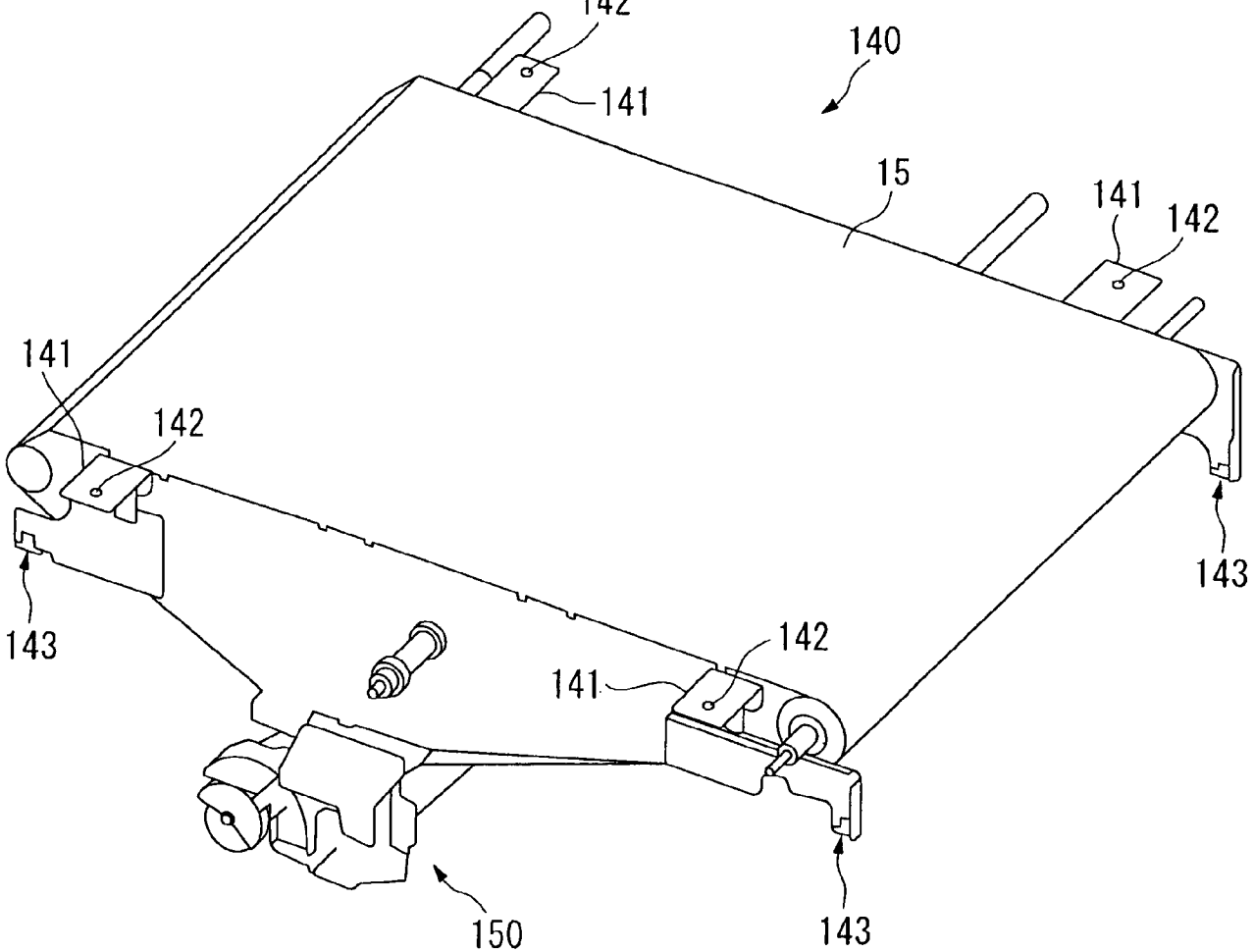
FIG. 4 is a perspective view showing a mechanism of a transfer module which moves up and down in a transfer unit in accordance with an embodiment of the present invention.

FIG. 4 is a perspective view showing a mechanism of the transfer module 140 which moves up and down in the transfer unit 130. In the transfer module 140, a locating unit 141 is provided to determine the position of the transfer module 140 behind (inboard, inside) and in front of (front side, out side) the apparatus. In an embodiment, the locating unit 141 has a pressed pin 142 that contacts a predetermined frame which connects to a holding unit of the photosensitive drum unit 110 and the case of apparatus in the main body 100, to determine the position of the locating unit 141 in a direction over the transfer module 140. When the transfer module 140 (the intermediate transfer belt 15) is lifted up by a contacting mechanism such as the pin 142, it determines the position in the direction over the transfer module 140 (the intermediate transfer belt 15). At a lower portion of the locating unit 141, a lower supporting unit 143 is positioned, which supports the transfer module 140, at the four corners of the transfer module 140.

Figure 5:
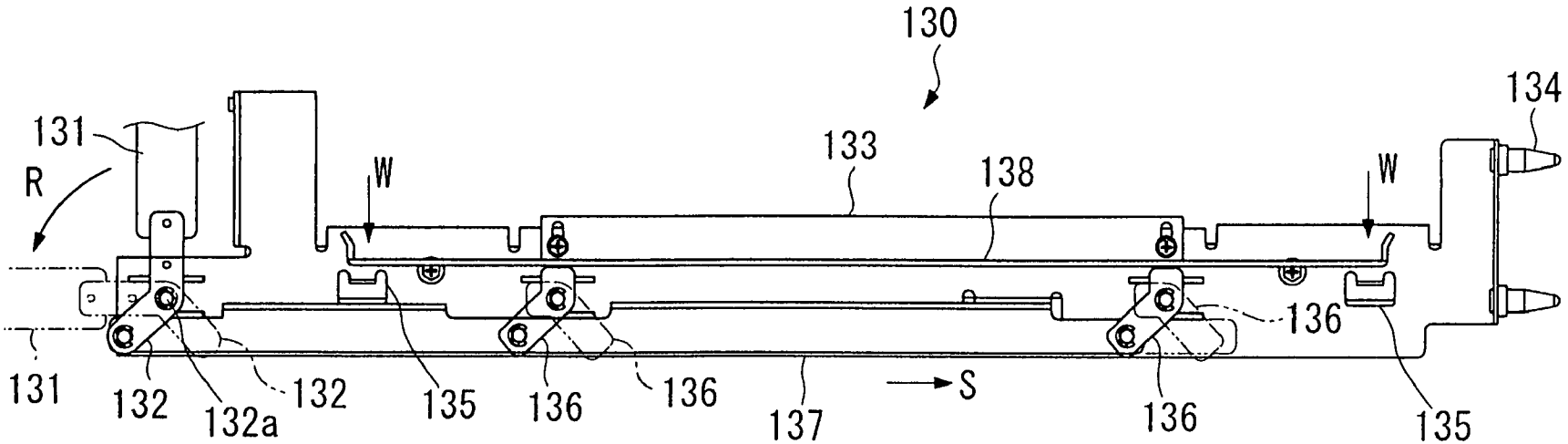
FIG. 5 is an view showing an up and down mechanism moving up and down the transfer module which is carried by the transfer unit in accordance with an embodiment of the present invention.

FIG. 5 is a view showing an up and down mechanism, which moves the transfer module 140 that is provided on the transfer unit 130. The mechanism as shown in FIG. 5 is provided at either end of the transfer unit 130. A lever 132 is provided in a frame 133 of the transfer unit 130, the lever 132 connecting to the handle 131 as depicted in FIG. 2 and FIG. 3. The lever 132 rotates on a point 132*a* by the operation of the handle 131. Additionally, locating pins 134, which determine the position of the transfer unit 130 to the case of the apparatus in the main body, are provided at the frame 133, for example, in the inboard side and front side, where the transfer unit 130 is attached to the apparatus. In addition, in the frame 133, a locating part 135 is provided, which determines the position when the transfer module 140 is pulled down.

In an embodiment, another side of the lever 132 is connected to a link 137. The link 137 is connected to a side of the plural pressing cams 136. A impressing spring 138 to contact the lower supporting unit 143 (as shown in FIG. 4) is provided in the other side of the plural pressing cams 136 and thus in the upper side of the link 137. The lower supporting units 143 are provided at the four corners of the transfer module 140 to support the transfer module 140 by the impressing spring 138 at the position of the arrow W, as shown in FIG. 5.

In the state shown by a solid line in FIG. 5, the handle 131 is in a perpendicular direction and the pressing cam 136 lifts the impressing spring 138 up to an upper direction. As a result, the transfer module 140 is lifted up to the upper direction through the lower supporting unit 143 by elastic force of the impressing spring 138. In this state, each of the photosensitive drums 11 of the image forming unit 10 (10Y, 10M, 10C, 10K) contact the intermediate transfer belt 15, and the image forming apparatus can perform the image forming operation. On the other hand, if the handle 131 is rotated in a direction as indicated by arrow R shown in FIG. 5, to the position as shown by a chain double-dashed line in FIG. 5, so that the lever 132 rotates counterclockwise on the point 132*a* and comes to the position of the chain double-dashed line as shown in FIG. 5, the link 137 slides to a direction as an arrow S shown in FIG. 5. By sliding the link 137, the pressing cam 136 rotates to the position as shown by the chain double-dashed line in FIG. 5, and the pressure of the impressing spring 138 is released. As a result, the transfer module 140 which is lifted up by the impressing spring 138 goes down under its own weight to a position which is supported by the locating part 135. Therefore, the intermediate transfer belt 15 can be removed from the photosensitive drums 11 of the image forming unit 10 (10Y, 10M, 10C, 10K) without causing damage to the drums. In an embodiment, the intermediate transfer belt 15 deflects by about 0.9 mm due to contact with the photosensitive drum 11. On the other hand, when the intermediate transfer belt 15 is removed from the photosensitive drums 11, a gap is maintained of about 2 mm between the intermediate transfer belt 15 and the photosensitive drums 11. Thus, the transfer module 140 moves up and down approximately 3 mm (or 2.9 mm) by the mechanism shown in FIG. 5.

Figure 6:
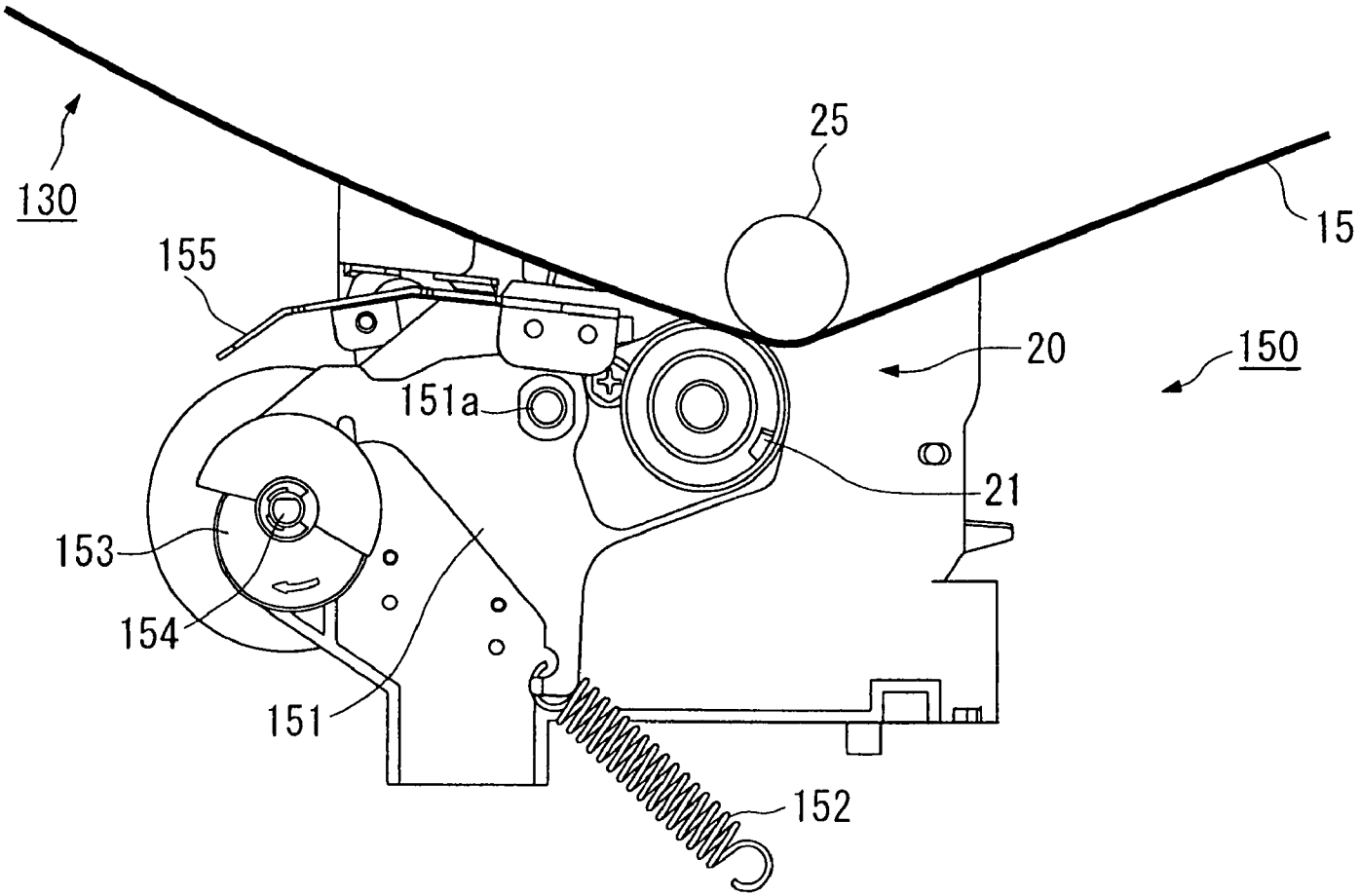
FIG. 6 is an view showing a pressing mechanism of a second transfer roller provided in a second transfer unit in accordance with an embodiment of the present invention.

Next, the second transfer unit 150 will be explained. FIG. 6 is a view showing a pressing mechanism of the second transfer roller 21 provided in the second transfer unit 150. FIG. 6 shows that, in an embodiment, the second transfer roller 21 contacts the intermediate transfer belt 15. The second transfer unit 150 has an oscillating arm 151 for contracting/retracting the second transfer roller 21 to the intermediate transfer belt 15, a coil spring 152 connected to the oscillating arm 151 for pressing the second transfer roller 21 to the backup roller 25, a retracting cam 153 for rotating the oscillating arm 151 on a point 151*a*, a rotational shaft 154 for rotating the retracting cam 153, and a transfer chute 155 for guiding the paper which is transferred to the second transfer part 20. In an embodiment, the transfer chute 155 can include a chute pushing cam (not shown) rotated with the retracting cam 153 for example, to move up and down.

Figure 7:
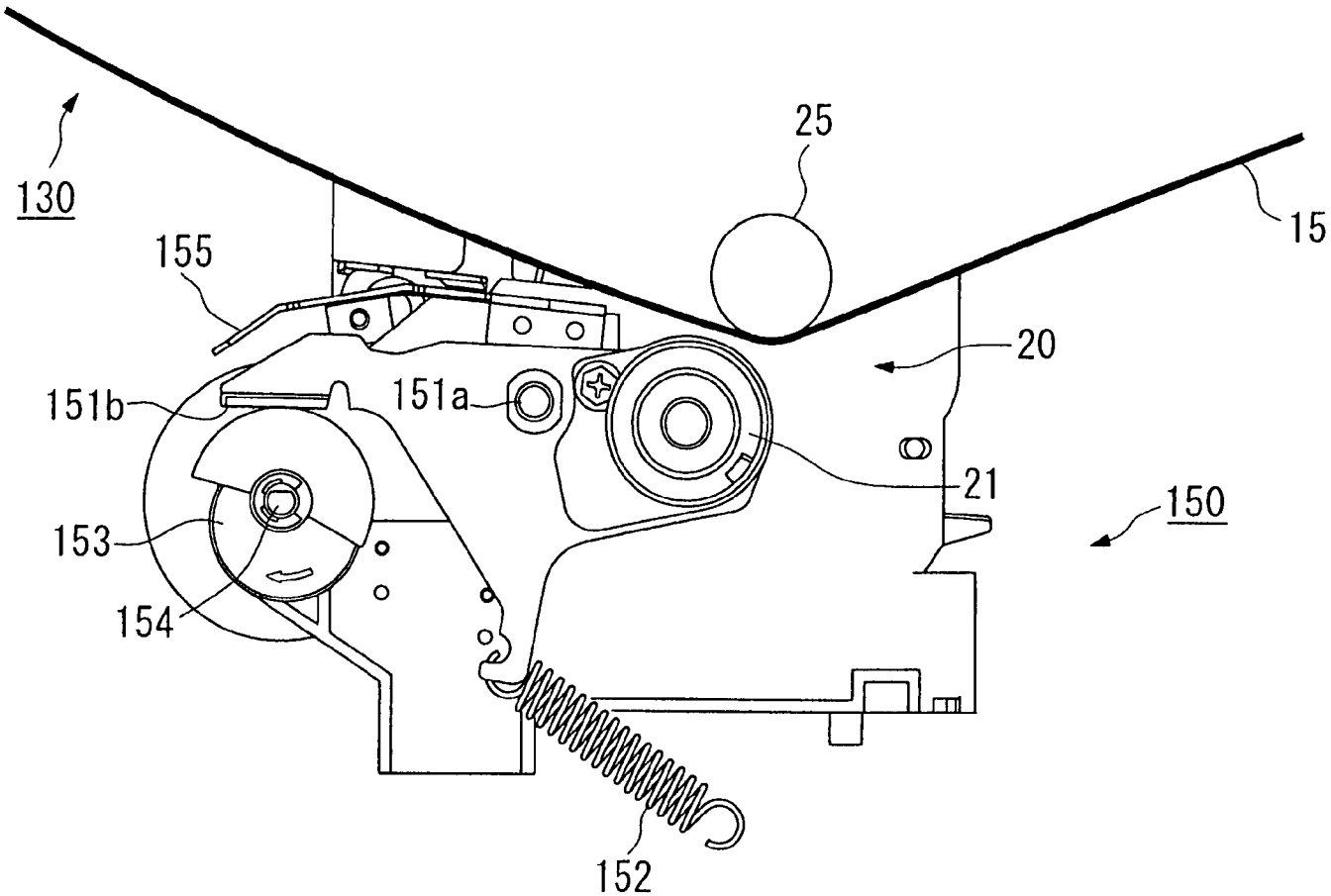
FIG. 7 is a view showing the state which the second transfer unit is retracted from the side of an intermediate transfer belt in accordance with an embodiment of the present invention.

In an embodiment, when transferring the retracting state (as shown in FIG. 7, described later) to the contacting state (as shown in FIG. 6), the retracting cam 153 is rotated by a rotation of the rotational shaft 154, removing the pressure of the retracting cam 153 from the lead edge of the oscillating arm 151. The oscillating arm 151 receives the force counterclockwise (left-handed rotation) by the coil spring 152, and it removes the pressure of the retracting cam 153, so that the oscillating 151 rotates counterclockwise (left-handed rotation) on the point 151*a*. Thereafter, since the pressure is removed from the retracting cam 153 to the oscillating arm 151 completely, a pushing force, in which the second transfer roller 21 pushes the backup roller 25 by the coiled spring 152, is given. Thus, the second transfer roller 21 is pressed to the backup roller 25 across the intermediate transfer belt 15 by predetermined pressure.

FIG. 7 is a view showing the state in which the second transfer unit 21 is retracted from the side of the intermediate transfer belt 15. Transferring from the contacting state (as shown in FIG. 6) to the retracting state (as shown in FIG. 7), the retracting cam 153 is rotated by the rotational shaft 154 and the lead edge 151*b* of the oscillating arm 154 is lifted up. As a result, the oscillating arm 151 rotates clockwise (right-handed rotation) on the point 151*a* and the second transfer roller 21 connected to the oscillating arm 151 is removed from the intermediate transfer belt 15.

When the image forming apparatus is not operating in the second transfer mode and when it is not operating in the image forming mode, the second transfer roller 21 is retracted from the intermediate transfer belt 15 as shown in FIG. 7. The toner is supported on the intermediate transfer belt 15 by the image forming process as shown in FIG. 1. Before conveying the toner image to the second transfer part 20 and conveying the paper to the part 20, the second transfer roller 21 contacts the intermediate transfer belt 15 to arrive in the state shown in FIG. 6. Thereafter, when the second transfer to the paper ends and there is no request to print additional paper, it transfers to the retracted state as shown in FIG. 7. Thus, when the image forming apparatus does not perform the second transfer, it retracts the second transfer roller 21 from the intermediate transfer belt 15. In the retracted state, it can pull out the second transfer unit 150 from the main body of the apparatus. Thus, since the second transfer roller 21 is retracted from the intermediate transfer belt 15, the second transfer roller 21 does not contact the intermediate transfer belt 15, even if the second transfer unit 150 is pulled out. As a result, wear resulting from contact between the second transfer roller 21 and the intermediate transfer belt 15 is reduced.

Figure 8:
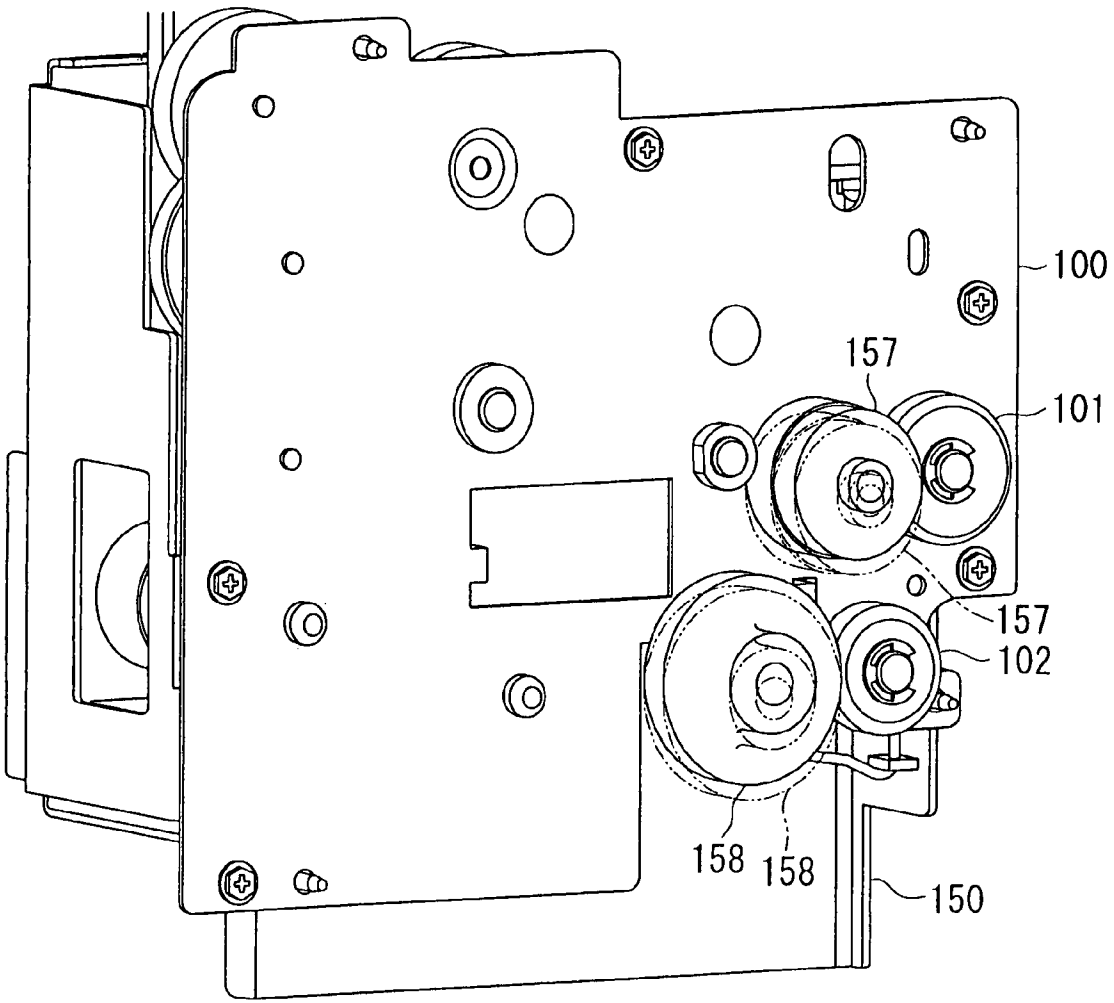
FIG. 8 is a perspective view showing a driving mechanism of the second transfer unit in accordance with an embodiment of the present invention.

FIG. 8 is a perspective view showing a driving mechanism of the second transfer unit 150 and an inboard view of the image forming apparatus according to an embodiment. The second transfer unit 150 has a first gear 157 and a second gear 158 for transmitting the driving force to each part of the second transfer unit 150. The first gear 157 is the gear for driving the second transfer roller 21, and the second gear 158 is the gear for driving the retracting cam 153 on the rotational shaft 154. In an embodiment, in the main body 100, a first driving gear 101 and a second driving gear 102 are provided as a driving unit. The first driving gear 101 is engaged with the first gear 157 of the second transfer unit 150 and the second driving gear 102 is engaged with the second gear 158 of the second transfer unit 150. In FIG. 8, the first gear 157 and the second gear 158 move up and down between the position shown in the solid line and the position shown in the chain double-dashed line. In both states, moving up or down, the first gear 157 is engaged with the first driving gear 101 and the second gear 158 is engaged with the second driving gear 102, as shown in the FIG. 8.

The up and down mechanism of the first gear 157 and the second gear 158 is linked to the up and down mechanism of the transfer module 140 by the handle 131. The transfer module 140 is held by the transfer unit 130. As described before, it is possible to move the second transfer unit 150 up and down with the intermediate transfer belt 15 (the transfer module 140), where the second transfer unit 150 maintains the relative positioning of the intermediate transfer belt 15 as the intermediate transfer body. However, even when the up and down mechanism is operated, the first gear 157 and the second gear 158 remain engaged with the first driving gear 101 and the second driving gear 102, respectively. In order to maintain the engagement, the first gear 157 and the second gear 158 are arranged in a position adjacent and nearly horizontal to the position of the first driving gear 101 and the second driving gear 102, respectively. For example, the first gear 157 and the first driving gear 101 are located at the same level, and the second gear 158 and the second driving gear 102 are located at the same level, allowing the respective gear pairs to always remain engaged irrespective of the functioning of the up and down mechanism. It may be understood that the engagement slides off by operating the up and down mechanism, if the gears move in the vertical direction. Additionally, the gears are located, and the teeth of the gears made larger so that it is possible to maintain engagement even when the up and down mechanism is operated. For example, a module m of the gear is about 1.2. Since the gears must necessarily engage when the transfer module 140 is pulled down and a driving force is transmitted to the second transfer unit 150, use of the stronger gears can prevent breakage or damage to the gears and gear teeth, even if the driving force is applied accidentally, such as when the transfer module 140 is pulled down during a test operation. While it is sometimes possible to lock the gears not to rotate when the transfer module 140 is pulled down, this may result in damage to the gears, for example, when a service technician unlocks and drives the gears to troubleshoot a fault, causing the gears are engaged unsuitably and possibly damaged. According to an embodiment of the present invention, such accidental damage is prevented by maintaining the engagement of the gears, even when the second transfer unit 150 moves up and down with the transfer module 140 in the main body 100.

Figure 9:
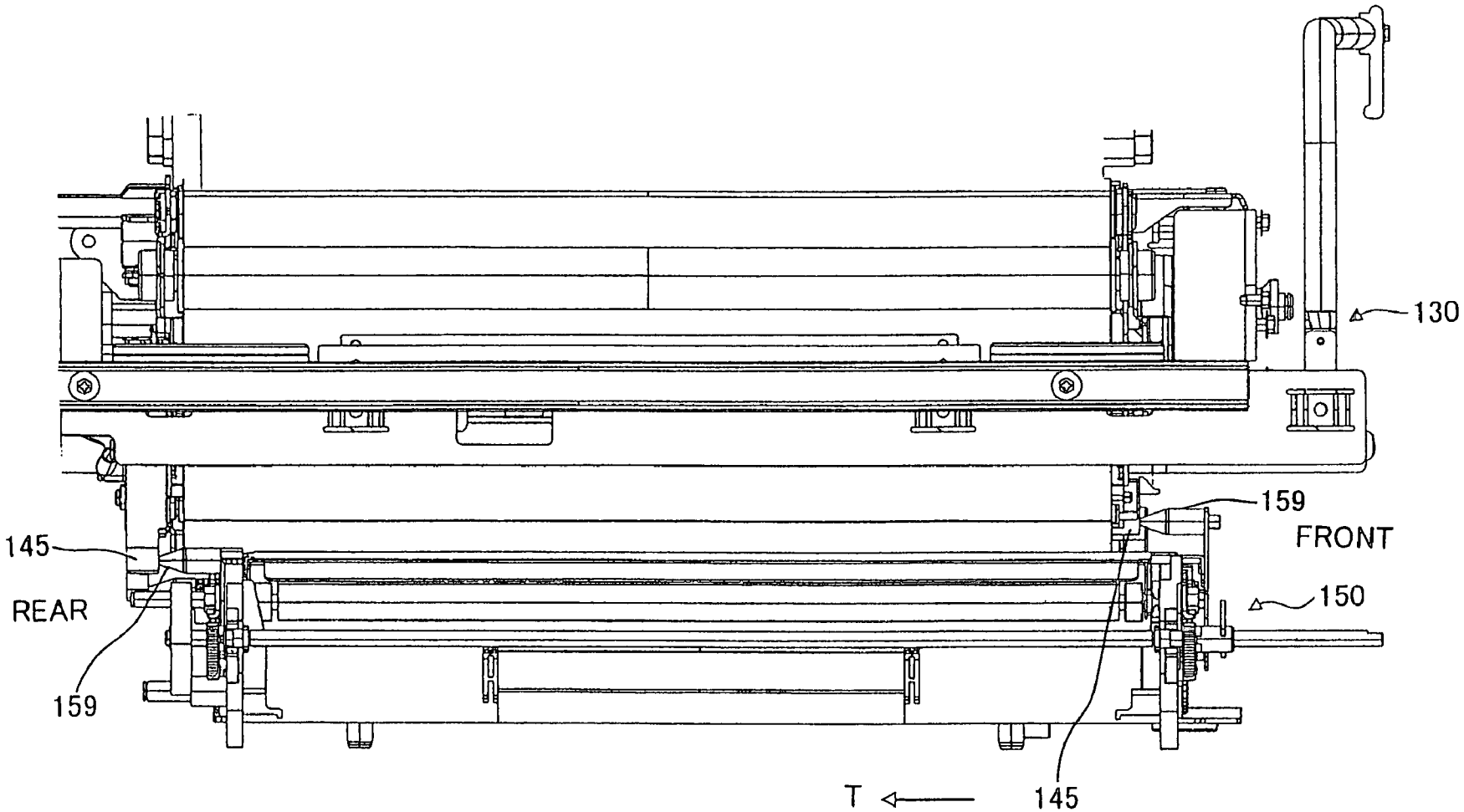
FIG. 9 is a view showing the locating method of second transfer unit.

FIG. 9 is a view showing the locating method of the second transfer unit 150. FIG. 9 depicts a view of the transfer unit 130 and the second transfer unit 150 from a side face of the main body of the image forming apparatus. In the second transfer unit 150, a pin 159 is provided at the inboard side and outboard side which is inserted into a hole 145 provided at the inboard side and outboard side of the transfer module 140 in the transfer unit 130. The second transfer unit 150 is pulled out from the transfer unit 130 and then it is pushed and moved in the direction indicated by arrow T shown in FIG. 9. The pin 159 of the second transfer unit 150 is located by inserting it into the hole 145 of the transfer module 140.

When the second transfer unit 150, described more fully later, is pulled out, the transfer module 140 of the transfer unit 130 is pulled down and the intermediate transfer belt 15 contacts the photosensitive drums 11 (the transfer module 140 may be lifted up). In an embodiment, the second transfer unit 150 has a length in a vertical direction to a rail provided in the main body 100, which the length has predetermined permissible range. As described above, the transfer module 140 moves up and down about 3 mm but the second transfer unit 150 is guided by the rail provided in the main body 100 and pulled out. In an embodiment, the pin 159 has a predetermined taper along the leading edge of the pin 159 and in a mouth of the hole 145, allowing the second transfer unit 150 to be pulled out and pushed in, engaging smoothly, when there is a difference in level of about 5 mm. Thus, even when there is the difference in alignment of about 5 mm, the second transfer unit 150 is positioned to the transfer module 140 of the transfer unit 130 precisely by following the taper provided in the leading edge of the pin 159 and in the mouth of the hole 145 as they engage. Therefore, in an embodiment, irregardless of whether intermediate transfer belt is in contact with the photosensitive drum 11 or removed, e.g., whether the transfer unit 130 is on the upper side or the lower side, it is possible to pull out and push in the second transfer unit 150.

Next, the operation of each unit will be explained. First, pulling our the photosensitive drum unit 110 will be explained. As shown in FIG. 2, the user or service technician cannot remove the photosensitive drum unit 110 with the handle 131 in the upright position because the handle 131 blocks removal of the photosensitive drum unit 110 when the handle 131 of the transfer unit 130 is lifted up. Therefore, when the photosensitive drum unit 110 is pulled out from the apparatus, as shown in FIG. 3, the handle is in the pulled down position, allowing the intermediate transfer belt 15 to be removed from the photosensitive drum 11. After that, in an embodiment, the entire photosensitive drum unit 110 may be pulled out. It is then possible to pull out the individual image forming units 10 (10Y, 10M, 10C, 10K) from the photosensitive drum unit 110. Since it is possible to pull out the photosensitive drum 11 from the main body 100 only when the intermediate transfer belt 15 is removed from the photosensitive drum 11, damage to the photosensitive drum 11 and the intermediate transfer belt 15, such as wear or scratching, is prevented. In an embodiment, instead of pulling out the whole of the photosensitive drum unit 110, it is possible to pull out the individual image forming units 10 (10Y, 10M, 10C, 10K) separately for cleaning and maintenance purposes.

Thus, in an embodiment, the transfer module 140 of the transfer unit 130 is able to move to the removed position only when the intermediate transfer belt 15 is removed from the photosensitive drum 11. Therefore, the design is simplified and operability is enhanced by lessening the chances of damaging components during removal (e.g., it is impossible to remove a photosensitive drum 11 without releasing the intermediate transfer belt 15). In embodiments having tandem-arranged plural photosensitive drums 11, the operation for removing the intermediate transfer belt 15 from the plural photosensitive drums 11 can be performed conveniently all at once greatly simplifying service procedures. In an embodiment, all components may be removed in one direction, resulting in a more compact design.

Next, removing the intermediate transfer belt 15 from the photosensitive drums 11, and operation of the second transfer roller 21, will be discussed. In an embodiment, the intermediate transfer belt 15 is between the second transfer roller 21 and the photosensitive drums 11. In this embodiment, it is possible for the second transfer unit 150, located by the intermediate transfer belt 15, to move up and down with the transfer module 140, and also position the intermediate transfer belt 15 (the transfer module 140) when the second transfer unit 150 is inserted. Thus, in an embodiment, it is not necessary to provide the up and down mechanism for the second transfer unit 150 separately because it is possible to position the second transfer unit 150 with respect to the intermediate transfer belt 15 (the transfer module 140) precisely, thus achieving space-savings. In an embodiment, the relationship between the second transfer unit 150 and the transfer module 140 is fixed independently of whether the belt is in contact with the photo sensitive drums 11, resulting in space-savings.

Figure 10:
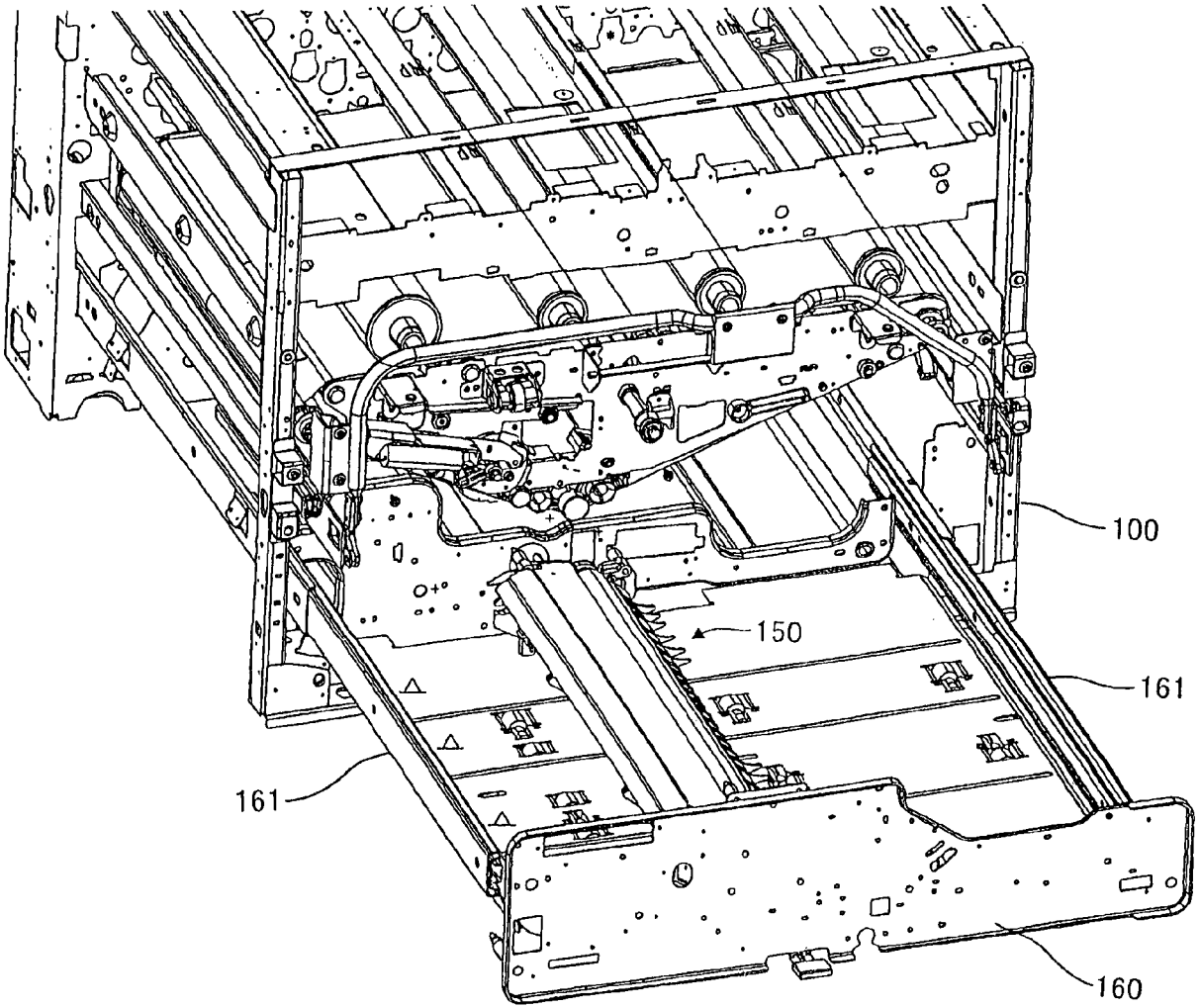
FIG. 10 is a view showing maintenance of second transfer unit in accordance with an embodiment of the present invention.

Next, operation of the second transfer unit 150 will be explained. FIG. 10 is a view showing maintenance of the second transfer unit 150. The second transfer unit 150 is provided in a drawer 160 and can slide from the main body 100 by a slide rail 161. FIG. 10 shows that the drawer 160 comprising the second transfer unit 150 may be pulled out from the main body 100. The second transfer unit 150 is linked to the drawer 160 by a shoulder screw for example, and it is possible to move up and down about 5 mm with respect to the drawer. Therefore, when the transfer module 140 provided in the transfer unit 130 moves up and down, the second transfer unit 150 may be located exactly with respect to the transfer module 140.

As has been described herein, in an embodiment, the second transfer unit 150 is removed electrically by the mechanism as shown in FIG. 6 and FIG. 7 from the second transfer roller 21 only from the intermediate transfer belt 15. The second transfer unit 150 is allowed to locate adjacent to the intermediate transfer belt 15 (the transfer module 140), while the second transfer unit 150 is inserted into the transfer module 140. Thus, the second transfer unit 150 can be exchanged and jam cleared only by pulling out the drawer 160, as shown in FIG. 10. In an embodiment, the drawer 160 has a paper transport system and the fixing unit 60 and they can be pulled out together as an assembly.

Figure 11:
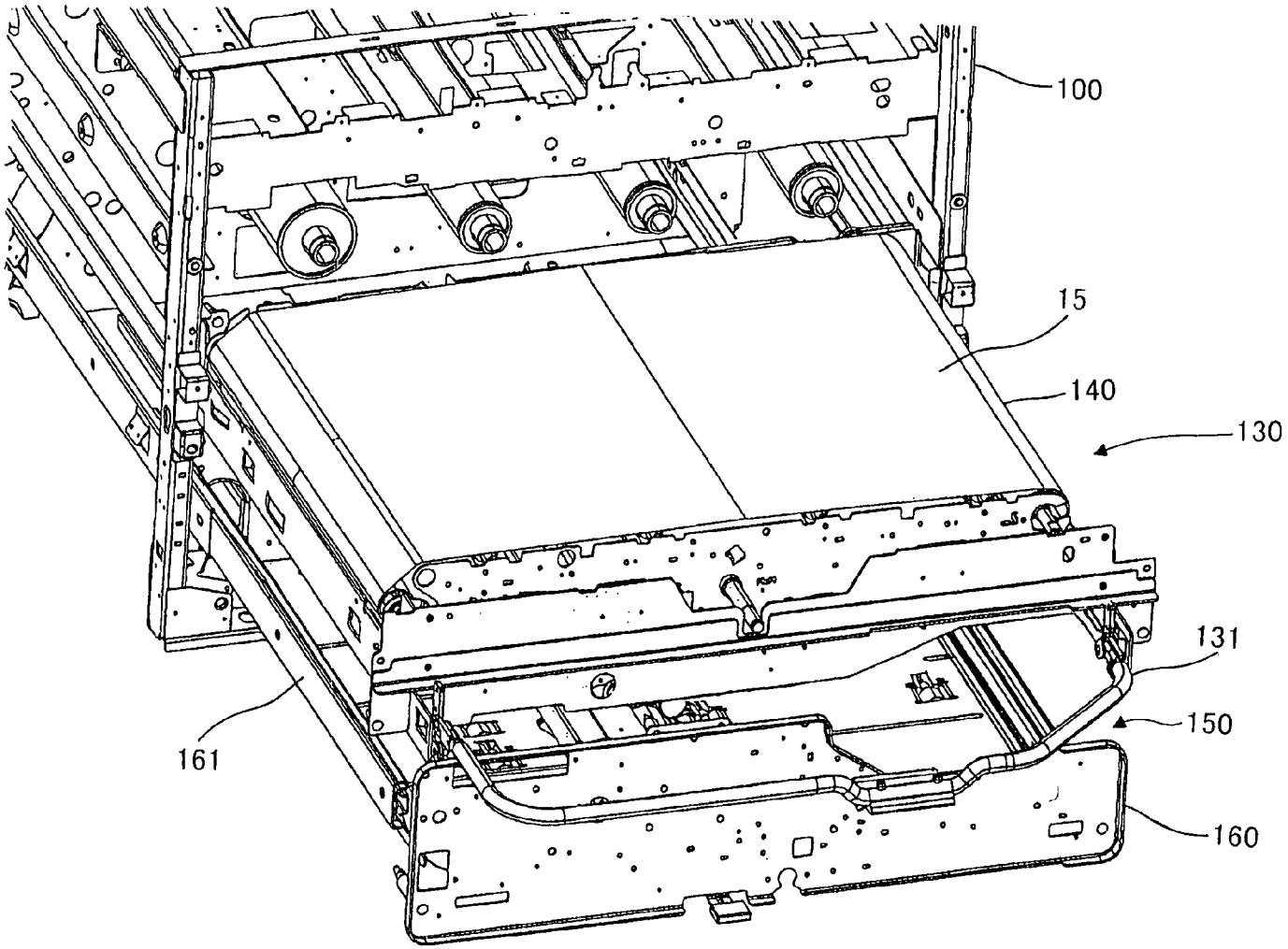
FIG. 11 is a view showing a pull out operation in accordance with an embodiment of the present invention.

FIG. 11 is a view showing the pull out operation. The transfer unit 130 is pulled out from the main body 100 in order to perform maintenance, such as component replacement. As described above, the intermediate transfer belt 15 can be removed from the photosensitive drum 11 as a unit, so that by operation of the handle 131, it is possible to pull out the transfer unit 130 easily. After pulling out the second transfer unit 150 as shown in FIG. 10 by pulling down the handle 131 as shown in FIG. 3, the transfer unit 130 is pulled out. As a result, maintenance can be performed, such as parts replacement of the components provided in the transfer unit 130. In an embodiment, there are two positions where the drawer comprising the second transfer unit may be pulled out. The two positions correspond to whether the second transfer unit can be inserted into the transfer unit or not. Where the second transfer unit cannot be inserted into the transfer unit, the transfer unit is detachable to the apparatus in an upper direction. In an embodiment, it is possible to pull out the second transfer unit 150 by pulling out the transfer unit 130 at the same time, not after pulling out the second transfer unit 150.

As described herein, in an embodiment, the image forming apparatus has the intermediate transfer belt 15 positioned as a sandwich structure, in which the intermediate transfer belt 15 is provided between each photosensitive drum 11 of the image forming unit 10 (10Y, 10M, 10C, 10K) and is contacted by each of them. It is possible to remove the intermediate transfer belt 15 from the photosensitive drums 11 by the simple mechanisms disclosed herein. Enhancing operability dramatically, the transfer unit 130 having the intermediate transfer belt 15 and the second transfer unit 150 having the second transfer roller 21 is particularly suitable, for example, where space requirement is reduced. In addition, it is possible to exchange the photosensitive drum 11, clear jams, perform maintenance, and enhance accessibility through the pull out and push operation. Moreover, the location of the units relative to one-another is maintained with high accuracy and precision. In an embodiment, the second transfer roller 21 may correspond to the second transfer member, or a belt member may be used instead of a roller member.

In addition, in an embodiment, the toner image supported by the photosensitive drum 11 is overprinted on the intermediate transfer belt 15 (endless belt) and then transferred secondarily to the paper. However, the apparatus is not limited to the above-described embodiments. The apparatus can be also applied to a general paper transport system, for example, in which the toner image supported by the photosensitive drum 11 is overprinted directly on the paper conveyed by a paper transport belt, which may be an endless belt.

Thus, according to aspects of this invention, damage, wear, and the like, that occurs when the various units are pulled out, is lessened or eliminated. Additionally, maintenance procedures are simplified and a more compact design is achieved.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but have the full scope defined by the language of the following claims, and equivalents thereof.

The entire disclosure of Japanese Patent Application No. 2003-135412 filed on May 14, 2003 including specification, claims, drawings and abstract is incorporated herein by reference in its entirety.

What is claimed is:

1. An image forming apparatus comprising:

a case;

an image carrier provided in the case for supporting an image;

an endless belt provided in the case for contacting the image carrier, the endless belt detachably in contact with the image carrier; and a contact member provided in the case for contacting the endless belt, the contact member moving with the endless belt when the endless belt is detached from the image carrier, wherein the contact member is capable of being pulled out from the case, by separating from the endless belt's position where the endless belt is contacting the image carrier or where the endless belt is not contacting the image carrier.

2. The image forming apparatus according to claim 1, wherein the contact member contacts the endless belt according to a predetermined timing during image formation, and the contact member is capable of being removed from the endless belt when the contact member is pulled out of the case.

3. The image forming apparatus according to claim 2, wherein the contact member is a second transfer member to transfer a toner image to a recording sheet, the toner image being intermediately transferred to the endless belt, and the contact member contacts the endless belt according to a predetermined second transfer timing.

4. The image forming apparatus according to claim 1, wherein the endless belt is positioned under the image carrier and the contact member is positioned under the endless belt to contact the endless belt from below.

5. The image forming apparatus according to claim 1, wherein the endless belt is an intermediate transfer belt or a paper transport belt.

6. The image forming apparatus according to claim 5, wherein a plurality of image carriers are arranged in relation to the endless belt to overprint toner images sequentially on the intermediate transfer belt or directly on a recording sheet conveyed by the paper transport belt.

7. An image forming apparatus comprising:

a main body;

a central unit having an endless belt and being provided in the main body;

a first unit having a first member for contacting a side of the endless belt and being provided in the main body; and a second unit having a second member for contacting an opposite side of the endless belt with respect to the first unit and being provided in the main body;

wherein the central unit moves with the second unit in a direction which removes the endless belt from the first member, the second unit detaches the second member from the endless belt where image is not formed, and detaches it from the main body independently of the movement of the central unit.

8. The image forming apparatus according to claim 7, wherein the central unit and the first unit are capable of being pulled out of the main body.

9. The image forming apparatus according to claim 7, wherein the second unit is positioned in the central unit by pushing the second unit into the main body from the state where it is pulled out, independently of the central unit.

10. The image forming apparatus according to claim 7, wherein the second unit is provided with a driving force from the main body, and where the second unit moves with the central unit.

11. The image forming apparatus according to claim 7, wherein the endless belt of the central unit is an intermediate transfer body, the first member of the first unit is an image carrier, and the second member of the second unit is a second transfer member.

12. An image forming apparatus comprising:

a main body;

an image carrier provided in the main body for supporting an image;

an intermediate transfer body provided in the main body for transferring the image supported by the image carrier; and a second transfer member for transferring the image to a recording sheet, the image being transferred on the intermediate transfer body, wherein the second transfer member moves with the intermediate transfer body in a direction which removes the intermediate transfer body from the image carrier, and the second transfer member is capable of receiving a driving force from the main body before and after the movement.

13. The image forming apparatus according to claim 12, wherein the second transfer member comprises a transmission gear that receives a driving force by connecting a gear of the main body with the transmission gear, the transmission gear being positioned in a direction perpendicular to the movement of the connecting gear of the main body.

14. The image forming apparatus according to claim 12, wherein the second transfer member may be removed from the main body independently of any movement of the intermediate transfer body.

* * * * *